US012075812B2

(12) United States Patent
Williams et al.

(10) Patent No.: US 12,075,812 B2
(45) **Date of Patent: *Sep. 3, 2024**

(54) ROD FORMING APPARATUS

(71) Applicant: Altria Client Services LLC, Richmond, VA (US)

(72) Inventors: Dwight D. Williams, Powhatan, VA (US); Mark A. Derigo, Richmond, VA (US); Gerald M. Dale, Richmond, VA (US); Charles David Howe, Crewe, VA (US)

(73) Assignee: Altria Client Services LLC, Richmond, VA (US)

( * ) Notice: Subject to any disclaimer, the term of this patent is extended or adjusted under 35 U.S.C. 154(b) by 42 days.

This patent is subject to a terminal disclaimer.

(21) Appl. No.: 17/849,212

(22) Filed: Jun. 24, 2022

(65) Prior Publication Data

US 2022/0322732 A1 Oct. 13, 2022

Related U.S. Application Data

(60) Continuation of application No. 16/382,834, filed on Apr. 12, 2019, now Pat. No. 11,395,505, which is a (Continued)

(51) Int. Cl.
*A24C 1/18* (2006.01)
*A24C 1/02* (2006.01)
(Continued)

(52) U.S. Cl.
CPC ..... *A24C 1/18* (2013.01); *A24C 1/02* (2013.01); *A24C 3/00* (2013.01); *A24C 5/1807* (2013.01); *Y10T 29/49826* (2015.01)

(58) Field of Classification Search
None
See application file for complete search history.

(56) References Cited

U.S. PATENT DOCUMENTS 1,772,715 A 8/1930 Grupe
2,395,089 A 2/1946 Arelt
(Continued)

FOREIGN PATENT DOCUMENTS

EP 0081391 A2 6/1983
EP 0410682 A2 1/1991

OTHER PUBLICATIONS

International Report on Patentability of International Application No. PCT/US2013/055836 dated Mar. 5, 2015.
(Continued)

*Primary Examiner* — Michael H. Wilson
*Assistant Examiner* — Katherine A Will
(74) *Attorney, Agent, or Firm* — Harness, Dickey & Pierce, P.L.C.

(57) ABSTRACT

An apparatus for the formation of machine-made tobacco rods for use in the production of smoking articles, such as cigars, from tobacco comprising a tacky material. The apparatus includes a pair of transfer and compression belts for receiving and compressing the stream of tobacco, the transfer and compression; a pair of squeeze bars for compressing the tobacco in a direction perpendicular to the pair of transfer and compression belts, the pair of squeeze bars produced from a material comprising a poly(aryl ether ketone); a tongue for receiving the compressed tobacco, the tongue produced from a material comprising a poly(aryl ether ketone); and a folder for folding a wrapper material around the compressed tobacco so as to form a continuous rod of tobacco, the wrapper material provided from a source of wrapper material, the folder produced from a material comprising a poly(aryl ether ketone).

20 Claims, 4 Drawing Sheets

Related U.S. Application Data division of application No. 13/971,590, filed on Aug. 20, 2013, now Pat. No. 10,575,551.

(60) Provisional application No. 61/691,023, filed on Aug. 20, 2012.

(51) Int. Cl.
*A24C 3/00* (2006.01)
*A24C 5/18* (2006.01)

(56) References Cited

U.S. PATENT DOCUMENTS

| | | | |
|---|---|---|---|
| 2,952,262 | A | 9/1960 | Pocock et al. |
| 3,646,942 | A | 3/1972 | Asbill et al. |
| 3,693,630 | A | 9/1972 | Kastner |
| 3,732,871 | A | 5/1973 | Molins et al. |
| 3,844,200 | A | 10/1974 | Sexstone |
| 3,915,176 | A | 10/1975 | Heitmann et al. |
| 3,955,584 | A | 5/1976 | Molins et al. |
| 4,310,476 | A | 1/1982 | Nahra et al. |
| 4,463,769 | A | 8/1984 | Leckband et al. |
| 4,567,725 | A | 2/1986 | Shinzawa et al. |
| 4,567,752 | A | 2/1986 | Labbe |
| 4,616,662 | A | 10/1986 | Hartmann et al. |
| 4,715,388 | A | 12/1987 | Rainer |
| 4,862,905 | A | 9/1989 | Green, Jr. et al. |
| 4,936,920 | A | 6/1990 | Keritsis et al. |
| 5,393,815 | A | 2/1995 | Takeda et al. |
| 5,497,794 | A | 3/1996 | Okumoto |
| 6,837,281 | B2 | 1/2005 | Spiers et al. |
| 7,479,098 | B2 | 1/2009 | Thomas et al. |
| 7,727,637 | B2 | 6/2010 | Park |
| 8,303,474 | B2 | 11/2012 | Iliev et al. |
| 8,747,876 | B2 | 6/2014 | Park |
| 9,255,502 | B1 | 2/2016 | Glass |
| 2001/0011239 | A1 | 8/2001 | Kondoh et al. |
| 2001/0019011 | A1 | 9/2001 | Schmick et al. |
| 2004/0154630 | A1 | 8/2004 | Tabuchi et al. |
| 2008/0248233 | A1 | 10/2008 | Levine et al. |
| 2011/0111239 | A1 | 5/2011 | Dandekar et al. |
| 2011/0139141 | A1 | 6/2011 | Shaffer et al. |
| 2012/0028774 | A1 | 2/2012 | Ercelebi et al. |
| 2012/0245006 | A1 | 9/2012 | Henley et al. |
| 2012/0282408 | A1 | 11/2012 | Jacob et al. |
| 2013/0180827 | A1 | 7/2013 | Cieslikowski et al. |
| 2014/0011652 | A1 | 1/2014 | Cieslikowski et al. |
| 2014/0048083 | A1 | 2/2014 | Williams et al. |

OTHER PUBLICATIONS

International Search Report of International Application No. PCT/US2013/055836 dated Apr. 2, 2014.

International Search Report of International Application No. PCT/US2013/055836 dated Feb. 4, 2014.

International Preliminary Report on Patentability of International Application No. PCT/US2013/055836 dated Feb. 24, 2015.

Office Action dated Feb. 5, 2019 for corresponding U.S. Appl. No. 14/988,104.

United States Final Office Action for corresponding U.S. Appl. No. 14/988,104, dated May 24, 2019.

United States Notice of Allowance for U.S. Appl. No. 13/971,590, dated Nov. 14, 2019.

United States Office Action for U.S. Appl. No. 14/988,104, dated Dec. 26, 2019.

United States Office Action for U.S. Appl. No. 14/988,104, dated May 13, 2020.

Definition of Tacky, Merriam-Webster Dictionary, https://www.merriam-webster.com/dictionary/tacky (year 2020).

United States Advisory Action for U.S. Appl. No. 14/988,104, dated Jul. 28, 2020.

U.S. Office Action dated Oct. 27, 2020 for corresponding U.S. Appl. No. 14/988,104.

U.S. Final Office Action dated Apr. 14, 2021 in corresponding U.S. Appl. No. 14/988,104 (11 pages).

U.S. Office Action dated May 14, 2021 for corresponding U.S. Appl. No. 16/382,834 (19 pages).

ROD FORMING APPARATUS

RELATED APPLICATION

This application is a Continuation of U.S. application Ser. No. 16/382,834, filed Apr. 12, 2019, which is a Divisional Application of U.S. application Ser. No. 13/971,590, filed Aug. 20, 2013, which claims the benefit of U.S. Provisional Application Ser. No. 61/691,023, filed on Aug. 20, 2012, the entire contents of each of which are hereby incorporated by reference.

FIELD

The present invention generally relates to tobacco rod formation in the manufacture of smoking articles, including cigar manufacturing and, in particular, to a method and apparatus for the formation of machine-made tobacco rods for use in the production of cigars.

ENVIRONMENT

In the manufacture of machine-made cigars, it is essential that tobacco be utilized as efficiently as possible due to its relatively high cost. In modern cigar manufacturing, it is also desirable to closely control the quantity of tobacco contained in each cigar, so as to provide a cigar that is considered well filled and is well filled on a consistent basis.

Tobacco utilization in the manufacture of machine-made cigars may be problematic with respect to certain tobacco blends. Machine-made cigars produced from pipe-tobacco blends have achieved wide acceptance in the market place. However, pipe-tobacco blends may have a degree of tackiness imparted thereto by the flavorants and other additives employed to enhance smoking enjoyment. The tacky, tobacco borne materials tend to stick to and accumulate along, guides, plows, garniture folding surfaces and the like of tobacco rod forming machines and other tobacco handling apparatus. Machines for making tobacco rods from pipe-tobacco blends are often modified to increase the clearances between parts (such as between a belt and a guide adjacent the belt) to accommodate the tacky pipe-tobacco blends, increasing the likelihood that the tobacco will escape and be utilized less efficiently, with greater tobacco waste.

There is a need for an improved method and apparatus for the manufacture of tobacco products, including machine-made cigars from tacky tobaccos, which will provide satisfactory cigars and be efficient in the use of tobacco.

SUMMARY

In one aspect, provided is a method of decreasing tobacco waste during the formation of machine-made tobacco rods for use in smoking articles such as in the production of cigars from tobacco having a tacky material combined therewith, The method includes the steps of providing a plurality of components of a rod-making machine, the plurality of components produced from a material comprising a poly(aryl ether ketone); reducing at least one gap between at least one of the plurality of components with an adjacent component of the rod-making machine to reduce the quantity of tobacco that may escape through the gap.

In one form, the method further includes the step of operating the rod-making machine to produce tobacco rods from a tobacco comprising a tacky material, wherein tobacco waste in the production of cigar rods is decreased.

In another form, the tobacco waste in the production of cigar rods is decreased by at least 25%.

In yet another form, the tobacco waste in the production of cigar rods is decreased by at least 50%.

In still yet another form, the tobacco waste in the production of cigar rods is decreased by at least 80%.

In a further form, the plurality of components are selected from a pair of squeeze bars (or guides or plows or rails) for compressing the tobacco, one or more pulleys for advancing transfer and/or compression belts, a tongue for guiding the tobacco, a short folder, or any combination thereof.

In a still further form, the poly(aryl ether ketone) is polyether ether ketone (PEEK).

In another aspect, provided is an apparatus for the formation of machine-made tobacco rods from a tobacco comprising a tacky material. The apparatus includes a lower conveyor belt and an upper compression belt for receiving and compressing a stream of tobacco, the lower conveyor belt and upper compression belt; a pair of squeeze bars for compressing the tobacco in a direction perpendicular to the pair of transfer and compression belts, the pair of squeeze bars produced from a material comprising a poly(aryl ether ketone); a tongue for receiving the compressed tobacco, the tongue produced from a material comprising a poly(aryl ether ketone); and a folder for folding a wrapper material around the compressed tobacco so as to form a continuous rod of tobacco, the wrapper material provided from a source of wrapper material, the short folder produced from a material comprising a poly(aryl ether ketone).

In one form, the upper and lower compression belts are driven by a plurality of pulleys, wherein the plurality of drive pulleys is produced from a material comprising a poly(aryl ether ketone).

In another form, the poly(aryl ether ketone) is polyether ether ketone (PEEK).

In yet another form, the apparatus includes a second heater bar operative to further cure a glue and to seal the wrapper material to form the continuous rod of tobacco.

In another aspect, provided is a method for the formation of machine-made tobacco rods from a tobacco comprising a tacky material. The method includes providing a stream of tobacco in a substantially uniform format; receiving and compressing the stream of tobacco between a lower conveyor belt and an upper compression belt; compressing the tobacco in a direction perpendicular (transverse) to the lower conveyor belt and upper compression belt between a pair of squeeze bars, the pair of squeeze bars produced from a material comprising a poly(aryl ether ketone); conveying the compressed tobacco downstream to a tongue, the tongue produced from a material comprising a poly(aryl ether ketone); providing a wrapper material from a source of wrapper material; and folding the wrapper material around the compressed tobacco so as to form a continuous rod of tobacco.

In one form, the step of folding the wrapper material around the compressed tobacco so as to form a continuous rod of tobacco utilizes a short folder produced from a material comprising a poly(aryl ether ketone).

In another form, the upper and lower compression belts are driven by a plurality of pulleys, wherein the plurality of drive pulleys is produced from a material comprising a poly(aryl ether ketone).

In still another form, the poly(aryl ether ketone) is polyether ether ketone (PEEK).

In yet another aspect, provided is a method of decreasing the waste of a tacky shredded material in a machine formation of a formed body. The method comprises the steps of providing a plurality of forming machine components, the plurality of components comprising a material characterized by a resistance to collecting the tacky shredded material and having a degree of wear resistance; and reducing at least one clearance gap between at least one of the plurality of components with an adjacent component of the forming machine to reduce the amount of the tacky shredded material that might escape through the gap.

In one form, the material characterized by a resistance to collecting the tacky shredded material and having a degree of wear resistance comprises a poly(aryl ether ketone).

In still yet another aspect, provided is an apparatus capable of forming a rod from a shredded material and a wrapper, the shredded material including a tacky constituent. The apparatus includes a feeder that establishes a moving column of the shredded material; opposing converging guides that compress the column as the column moves along the opposing converging guides, the opposing converging guides constructed from a material comprising a poly(aryl ether ketone); a folding surface that forms the rod as the compressed column and the wrapper are drawn through the folding surface, the folding surface constructed from a material comprising a poly(aryl ether ketone).

In another aspect, provided is a method for the formation of machine-made tobacco rods for use in the production of smoking articles such as cigars from tobacco comprising a tacky material. The method includes providing a stream of tobacco in a substantially uniform format; receiving and compressing the stream of tobacco between a pair of transfer and compression belts; compressing the tobacco in a direction perpendicular to the pair of transfer and compression belts between a pair of squeeze bars, the pair of squeeze bars formed from a thermoplastic material polymerized by the dialkylation of a bisphenolate salt; conveying the compressed tobacco downstream to a tongue, the tongue formed from a thermoplastic material polymerized by the dialkylation of a bisphenolate salt; providing a wrapper material from a source of wrapper material; and folding the wrapper material around the compressed tobacco so as to form a continuous rod of tobacco.

In one form, the step of folding the wrapper material around the compressed tobacco so as to form a continuous rod of tobacco for use in the production of smoking articles, utilizes a folder formed from a thermoplastic material polymerized by the dialkylation of a bisphenolate salt. In another form, the plurality of drive pulleys comprises a thermoplastic material polymerized by the dialkylation of a bisphenolate salt. In still another form, the thermoplastic material polymerized by the dialkylation of a bisphenolate salt is polyether ether ketone (PEEK).

In one aspect, provided is a method of decreasing tobacco waste during the formation of machine-made tobacco rods for use in the production of smoking articles such as cigars from tobacco comprising a tacky material, The method includes the steps of providing a plurality of components of a rod-making machine, the plurality of components comprising a thermoplastic material polymerized by the dialkylation of a bisphenolate salt; reducing at least one gap between at least one of the plurality of components with an adjacent component of the rod-making machine to reduce the amount of tobacco that escapes through the gap.

In one form, the method further includes the step of operating the rod-making machine to produce rods from the tobacco comprising a tacky material, wherein tobacco wasted in the production of the rods is decreased.

In another form, the tobacco waste in the production of cigar rods is decreased by at least 25%. In yet another form, the tobacco waste in the production of tobacco rods is decreased by at least 50%. In still yet another form, the tobacco waste in the production of tobacco rods is decreased by at least 80%. Tobacco waste is reduced by forming at least some components with PEEK and decreasing tolerance gaps between the components formed from PEEK by at least 20%, or at least 30%, or at least 40% or more.

In a further form, the plurality of components are selected from a pair of squeeze bars for compressing the tobacco, one or more pulleys for advancing transfer and/or compression belts, a tongue for guiding the tobacco, a folder, or any combination thereof. In a still further form, the thermoplastic material polymerized by the dialkylation of a bisphenolate salt is polyether ether ketone (PEEK).

BRIEF DESCRIPTION OF THE DRAWINGS

The forms disclosed herein are illustrated by way of example, and not by way of limitation, in the figures of the accompanying drawings and in which like reference numerals refer to similar elements and in which.

DETAILED DESCRIPTION

Figure 1B:
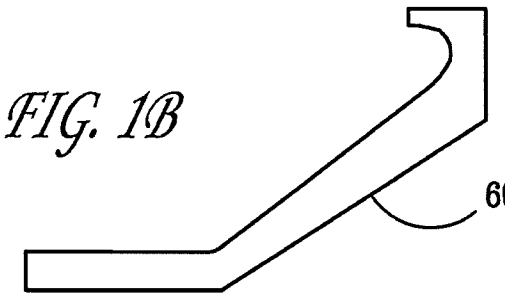
FIG. 1*b* is a side planar view of squeeze bar 60, as shown in FIG. 1*a;*

Various aspects will now be described with reference to specific forms selected for purposes of illustration. It will be appreciated that the spirit and scope of the apparatus, system and methods disclosed herein are not limited to the selected forms. Moreover, it is to be noted that the figures provided herein are not drawn to any particular proportion or scale, and that many variations can be made to the illustrated forms. Reference is now made to FIGS. 1-10, wherein like numerals are used to designate like elements throughout.

Each of the following terms written in singular grammatical form: "a," "an," and "the," as used herein, may also refer to, and encompass, a plurality of the stated entity or object, unless otherwise specifically defined or stated herein, or, unless the context clearly dictates otherwise. For example, the phrases "a device," "an assembly," "a mechanism," "a component," and "an element," as used herein, may also refer to, and encompass, a plurality of devices, a plurality of assemblies, a plurality of mechanisms, a plurality of components, and a plurality of elements, respectively.

Each of the following terms: "includes," "including," "has," "having," "comprises," and "comprising," and, their linguistic or grammatical variants, derivatives, and/or conjugates, as used herein, means "including, but not limited to."

Throughout the illustrative description, the examples, and the appended claims, a numerical value of a parameter, feature, object, or dimension, may be stated or described in terms of a numerical range format. It is to be fully understood that the stated numerical range format is provided for illustrating implementation of the forms disclosed herein, and is not to be understood or construed as inflexibly limiting the scope of the forms disclosed herein.

Moreover, for stating or describing a numerical range, the phrase "in a range of between about a first numerical value and about a second numerical value," is considered equivalent to, and means the same as, the phrase "in a range of from about a first numerical value to about a second numerical value," and, thus, the two equivalently meaning phrases may be used interchangeably.

It is to be understood that the various forms disclosed herein are not limited in their application to the details of the order or sequence, and number, of steps or procedures, and sub-steps or sub-procedures, of operation or implementation of forms of the method or to the details of type, composition, construction, arrangement, order and number of the system, system sub-units, devices, assemblies, sub-assemblies, mechanisms, structures, components, elements, and configurations, and, peripheral equipment, utilities, accessories, and materials of forms of the system, set forth in the following illustrative description, accompanying drawings, and examples, unless otherwise specifically stated herein. The apparatus, systems and methods disclosed herein can be practiced or implemented according to various other alternative forms and in various other alternative ways.

It is also to be understood that all technical and scientific words, terms, and/or phrases, used herein throughout the present disclosure have either the identical or similar meaning as commonly understood by one of ordinary skill in the art, unless otherwise specifically defined or stated herein. Phraseology, terminology, and, notation, employed herein throughout the present disclosure are for the purpose of description and should not be regarded as limiting.

As can be the case in the manufacture of certain machine-made smoking articles, such as cigars, the tobacco may comprise a tacky material combined therewith prior to or during rod formation, such as by way of addition of flavorants and other additives. Examples of suitable types of tobaccos that may be used in the manufacture of machine-made cigars include, but are not limited to, flue-cured tobacco, Burley tobacco, Maryland tobacco, Oriental tobacco, rare tobacco, specialty tobacco, reconstituted tobacco, blends thereof and the like. Optionally, the tobacco may be pasteurized. In the alternative, the tobacco material may be fermented.

Suitable flavorants and aromas include, but are not limited to, any natural or synthetic flavor or aroma, such as tobacco, smoke, menthol, mint (such as peppermint and spearmint), chocolate, licorice, citrus and other fruit flavors, gamma octalactone, vanillin, ethyl vanillin, breath freshener flavors, spice flavors such as cinnamon, methyl salicylate, linalool, bergamot oil, geranium oil, lemon oil, and ginger oil. Other suitable flavors and aromas may include flavor compounds selected from the group consisting of an acid, an alcohol, an ester, an aldehyde, a ketone, a pyrazine, combinations or blends thereof and the like. Suitable flavor compounds may be selected, for example, from the group consisting of phenylacetic acid, solanone, megastigmatrienone, 2-heptanone, benzylalcohol, cis-3-hexenyl acetate, valeric acid, valeric aldehyde, ester, terpene, sesquiterpene, nootkatone, maltol, damascenone, pyrazine, lactone, anethole, iso-valeric acid, combinations thereof and the like.

Exemplary additional natural and artificial flavorants include, but are not limited to, peppermint, spearmint, wintergreen, menthol, cinnamon, chocolate, vanillin, licorice, clove, anise, sandalwood, geranium, rose oil, vanilla, lemon oil, cassia, fennel, ginger, ethylacetate, isoamylacetate, propylisobutyrate, isobutylbutyrate, ethylbutyrate, ethylvalerate, benzylformate, limonene, cymene, pinene, linalool, geraniol, citronellol, citral, orange oil, coriander oil, borneol, fruit extract, and the like. Particularly preferred additional flavor and aroma agents are essential oils and/or essences of coffee, tea, cacao, and mint.

Humectants can also be added to the tobacco material to help maintain the moisture levels. Examples of humectants that can be used with the tobacco include glycerol and propylene glycol. It is noted that the humectants can also be provided for a preservative effect, as the water activity of the product can be decreased with inclusion of a humectant, thus reducing opportunity for growth of micro-organisms. Additionally, humectants can be used to provide a higher moisture feel to a drier tobacco component.

In one form, the tobacco used in the manufacture of machine-made cigars employing the apparatus and methods disclosed herein is a pipe tobacco blend having a degree of tackiness imparted thereto.

Figure 1A:
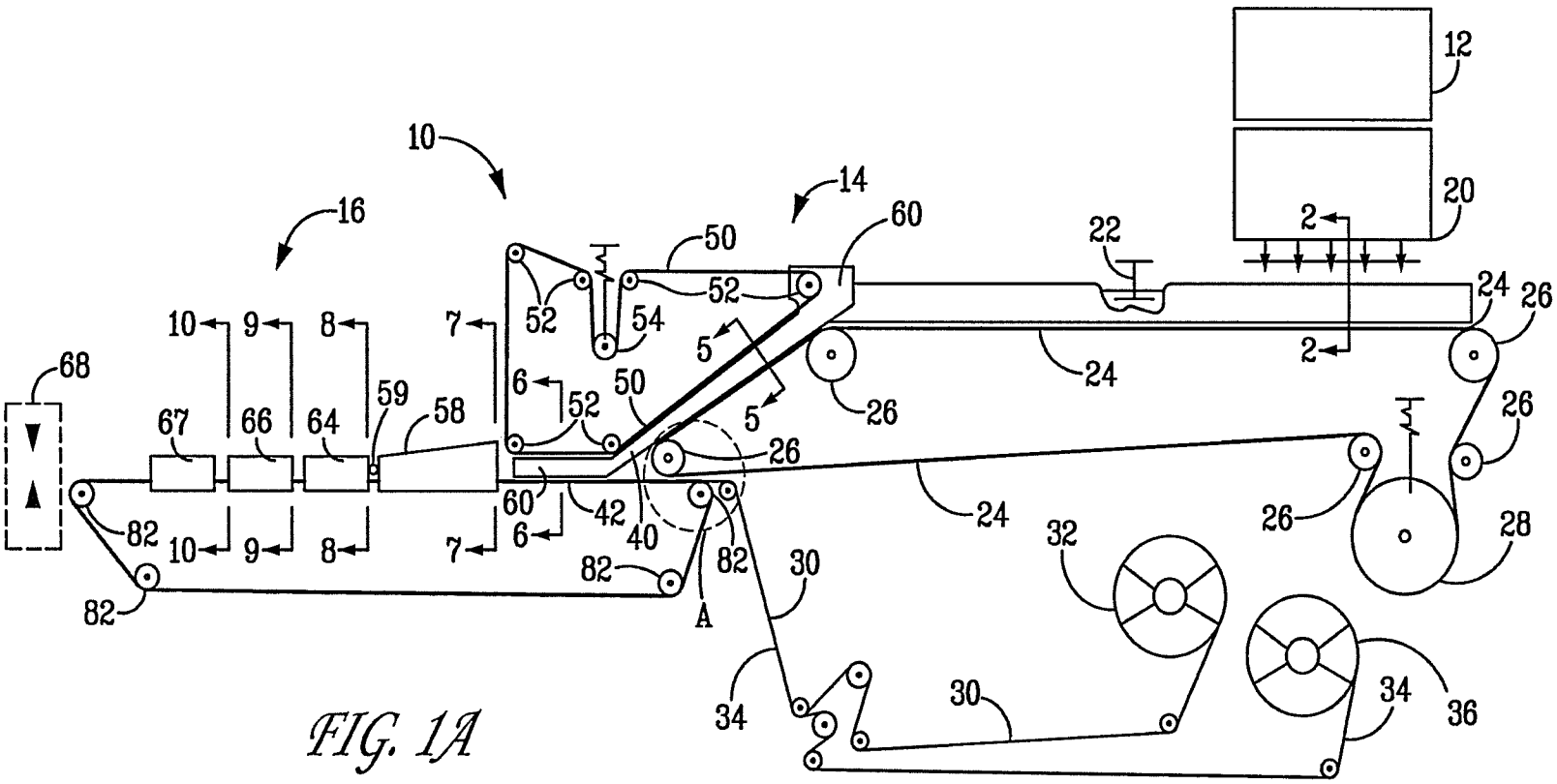
FIG. 1*a* schematically presents an apparatus for the formation of machine-made tobacco rods, in accordance herewith.

Referring to FIG. 1, an apparatus 10 for the formation of machine-made tobacco rods is schematically presented. Advantageously, apparatus 10 is particularly useful in the production of cigars from tobacco comprising a tacky material. One such application is the production of cigars from a form of pipe tobacco.

As shown, the apparatus 10 includes a tobacco feed section 12, an in-feed section 14 and a finishing section 16. The tobacco feed section 12 may include at least one conveyer (not shown) for receiving a stream of tobacco from a source of tobacco. Tobacco feed section 12 may also include at least one electromagnetic vibrator (not shown) for providing the stream of tobacco in a substantially uniform format. Suitable electromagnetic vibrators 18 are available from Eriez Corporation of Erie, PA and possess the ability provide for the relatively high speed feeding of light, bulky materials.

In one form, the in-feed section 12 may be constructed from existing equipment, such as an in-feed section of an AMF cigarette making machine. The finishing section 16 may also be constructed from existing equipment, such as a Molins Mk 8 or Mk 9 machine, available from Molins PLC of Milton Keynes, UK.

Referring still to FIG. 1, in one form, a vibratory waterfall feeder 20 is positioned downstream of the tobacco feed section 12 for receiving the stream of tobacco. The vibratory waterfall feeder 20 feeds tobacco to an in-feed section 14, establishing a column of tobacco along a lower conveyor belt 24, which is driven and guided by a plurality of pulleys 26. The lower conveyor belt 24 is kept in tension by a biased tension pulley 28. The stream of tobacco may optionally proceed past a trimmer unit 22, to establish a uniform height along the column of tobacco established atop the lower conveyor belt 24 by the vibratory waterfall feeder 20.

Figure 2:
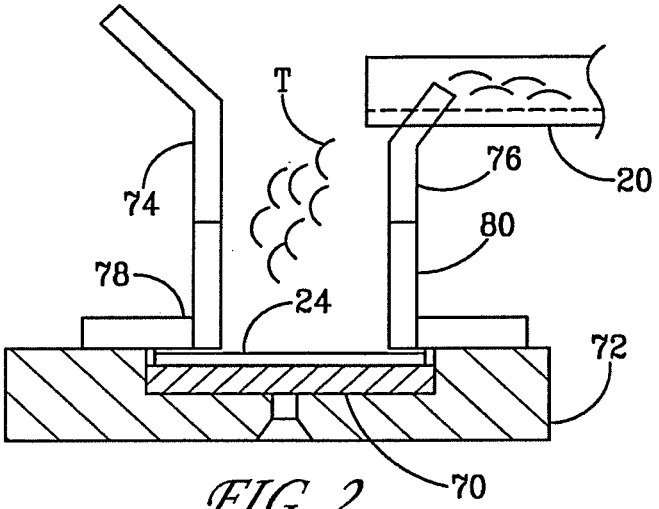
FIG. 2 is a cross-sectional view taken through section 2-2 of FIG. 1*a;*

Referring now to FIG. 2, a view of the apparatus 10 taken through Section 2-2 is presented. As shown, a lower conveyor belt 24 rides above a conveyor guide 70, the conveyor guide 70 being preferably positioned within a conveyer base plate 72. Tobacco T from the vibratory waterfall feeder 20 is deposited upon the lower conveyor belt 24. A first trough member 74 and a second, opposing trough member 76 guide the tobacco T onto the lower conveyor belt 24. The first trough member 74 is affixed to a first angle bracket 78 and the second trough member 76 is affixed to a second angle bracket 80. As shown, the first angle bracket 78 and the second angle bracket 80 may extend over a portion of the lower conveyor belt 24 so as to maintain the position of the lower conveyor belt 24 within the conveyer base plate 72.

Referring again to FIG. 1, in one form, the in-feed section 14 includes an upper (compression) belt 50 positioned downstream of the vibratory waterfall feeder 20, above and in opposing relation with at least a portion of the lower conveyor belt 24 and is likewise disposed in an opposing relation with at least a portion of a transfer or garniture tube belt 42. The upper compression belt 50 and a portion of the garniture tube belt (or transfer belt) 42 are configured to receive and compress the stream of tobacco. The compression belt 50 is preferably driven and guided by a plurality of pulleys 52 and is kept in tension by a tension pulley 54.

Figure 3:
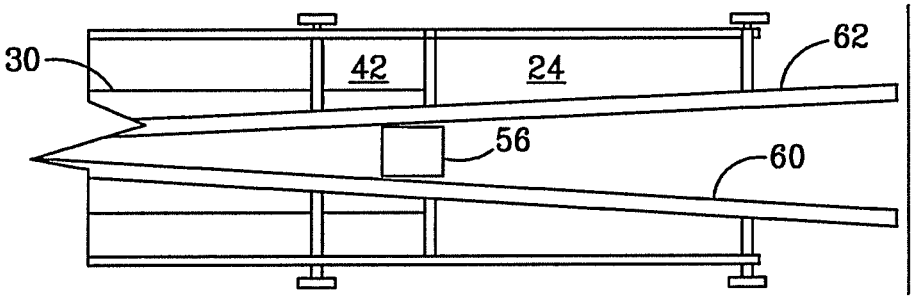
FIG. 3 schematically presents a top view of the in-feed section of an apparatus for the formation of machine-made tobacco rods, in accordance herewith.

Referring also to FIG. 3, squeeze bars 60 and 62 are provided in a mutually opposing, converging relation for compressing the tobacco in a transverse direction (side to side), while also the compression belt 50 and the lower conveyor belt 24 are in a mutually opposing, converging relation for compressing the tobacco from top to bottom of the tobacco column. At the furthest end of the lower conveyor belt 24, the tobacco column is transferred from the lower conveyor belt 24 onto a continuous ribbon of binder web 30, which is supplied from a source of binder web 32. The binder web 30 is mated with a wrapper web 34, which is supplied from a source of wrapper web 36, and is supported and drawn by a transfer or garniture tube belt 42. In the embodiments, the binder web 30 and the wrapper web 34 comprise tobacco.

Figure 4:
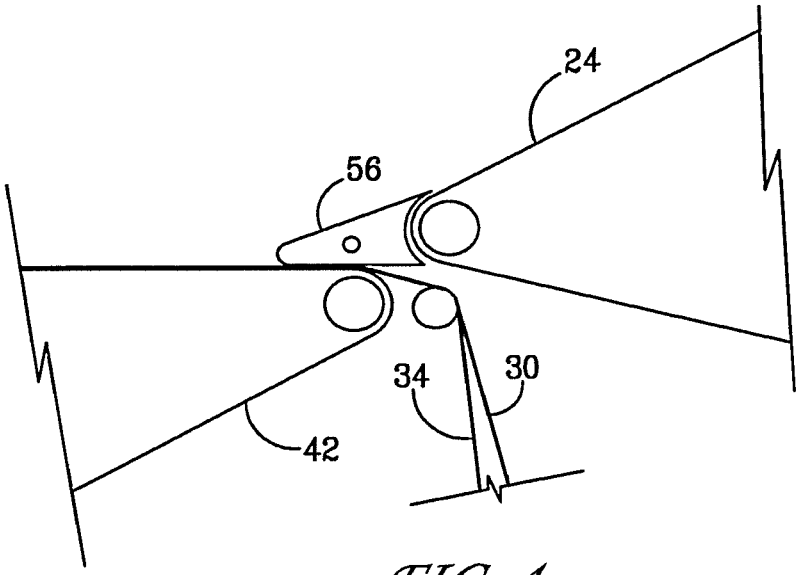
FIG. 4 presents an exploded view of Section A of FIG. 1*a;*

Referring now to FIG. 4, an exploded schematic view of Section A of FIG. 1 is presented. As shown, in one form, a transition piece 56 is employed to bridge the transition from the lower conveyor belt 24 to the garniture tube belt 42, creating a smoother path for a tobacco column to traverse. Additionally, the transition piece 56 serves to reduce the level of turbulence that might otherwise be imparted to a tobacco column traversing the transition from the lower conveyor belt 24 to the garniture tube belt 42. The transition piece 56 occupies space at the transition between the belts 24 and 42, which space would otherwise allow tobacco to accumulate and intermittently release, with impact on product consistency.

Figure 5:
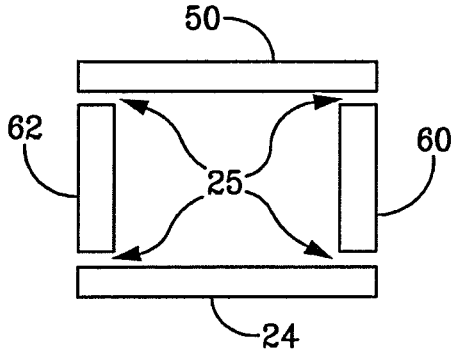
FIG. 5 is a cross-sectional view taken through Section 5-5 of FIG. 1*a;*
Figure 6:
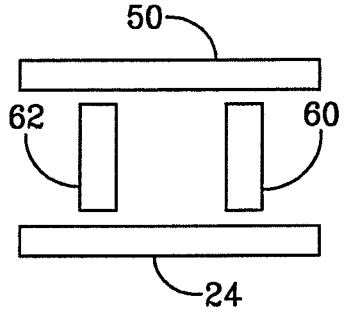
FIG. 6 is a cross-sectional view taken through Section 6-6 of FIG. 1*a*.

Referring again to FIG. 1, the formation of the tobacco column will be described in more detail. As the tobacco stream enters the arrangement formed by the pair of squeeze bars 60 and 62, the lower conveyor belt 24, and the upper compression belt 50, the cross-sectional area of the arrangement is continuously reduced, forcing the tobacco to be compressed into an ever-smaller cross-section, until it reaches a desired cross-sectional dimension. Referring to FIG. 5, a cross-sectional view of Section 5-5 of FIG. 1 is presented. As may be seen a cross-sectional-area is formed by the arrangement formed by the squeeze bars 60 and 62, the lower conveyor belt 24, and the upper compression belt 50. Moving along apparatus 10 to Section 6-6 of FIG. 1, reference is made to FIG. 6, wherein a reduced cross-sectional-area is depicted. As one of ordinary skill in the art would recognize small clearances or gaps exist along the corners 25 of the arrangement.

As the column of tobacco proceeds into the finishing section 16 it is drawn through a rod-forming arrangement 40, which includes a tongue 58. The rod-forming arrangement 40 is configured and arranged to fold the binder and the wrapper web 30 and 34, respectively, longitudinally around the tobacco column and, in one form, employs a first garniture (or short folder) 64 and a second (or finishing folder) 66 for folding the wrapper web about the compressed tobacco column so as to form a continuous rod of tobacco suitable for use in the production of smoking articles, such as cigars, the wrapper web provided from a source of wrapper material. An adhesive, which may be an adhesive such as PVA, is applied by an adhesive applicator 59 to one lap edge of the wrapper web 34, and seals the lap joint by applying heat, by at least one heater 67 to set the adhesive.

Figure 7:
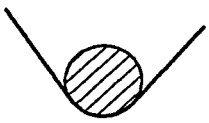
FIGS. 7-10 present cross-sectional views of a tobacco rod as it progresses through the folding (or rolling) operation.
Figure 8:
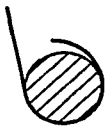
Figure 9:
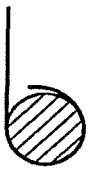
Figure 10:
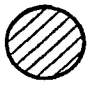

To further demonstrate the folding or rolling operation, reference is made to FIG. 1 and to FIGS. 7-10, where cross-sections of a tobacco rod are presented to show the relative state of wrapper/binder folding or rolling at various positions along the length of the rod-forming arrangement 40. As shown in FIG. 7, taken at Section 7-7 of FIG. 1 at the entrance to the tongue 63, the folding process has yet to begin. As shown in FIG. 8, taken at Section 8-8 of FIG. 1 at the entrance to the short folder 64, the folding operation has begun, with an upper lap edge of the wrapper/binder 30/34 extending substantially vertically and having had an application of glue applied thereto by the adhesive applicator 59. Referring now to FIG. 9, taken at Section 9-9 of FIG. 1 at the entrance to the second folder 66, it may be seen that one side of the wrapper/binder 30/34 has been fully rolled over, while the upper lap edge of the wrapper/binder 30/34 still extends substantially vertically. Referring now to FIG. 10, taken at Section 10-10 of FIG. 1 at the exit of the second folder 66, it may be seen that the tobacco rod has been fully formed and ready for heating to set the glue applied by the adhesive applicator 67.

A continuous rod is thus produced and is carried by the garniture tube belt 42 through an optional air bearing arrangement (not shown). The rod then emerges from the garniture tube belt 42 and may pass through a weight scanner (not shown) and then through a diameter gauge (not shown) before being cut into discrete rod lengths by a cutter 68.

When forming tobacco rods, particularly when the tobacco is of the type similar to that frequently marketed as pipe tobacco, the tobacco tends to accumulate on the machine surfaces. In manufacturing operations, to mitigate the problems associated with this accumulation, opposing parts were designed to have greater clearances, greater than a nominal clearance. The greater clearances permitted the escape of tobacco during machine operation.

It has been discovered that the use of a semi-crystalline thermoplastic material, which also has a desired degree of wear resistance, to fabricate parts of the rod making apparatus that come into contact with tobacco, reduces or eliminates tobacco accumulation on machine parts having surfaces that come into contact with tobacco, permitting closer clearances to be employed between many of the parts, including clearances 25, as shown in FIG. 5. Previously, clearances, such as clearances 25, were set to a dimension on the order of about 0.100 inches. Advantageously, the application of the semi-crystalline thermoplastic materials disclosed herein permit the setting of such clearances to values of about 20 percent of their previous values, such as in this example to about 0.020 inches. The preferred semi-crystalline thermoplastic materials include nylon and the poly(aryl ether ketone)s, such as polyether ether ketone (PEEK) and poly (ether ketone ketone) (PEKK).

As may be appreciated, closer clearances enable improved tobacco utilization, since the escape of tobacco is reduced or minimized during the rod making operation. In operation, the resultant rod making machine is cleaner, faster, more consistent, more flexible, and more efficient than prior designs. As may be appreciated, such advantages can lead to the production of higher quality product.

Poly(aryl ether ketone)s are generally synthesized by an aromatic nucleophilic substitution reaction of activated aryl dihalides with aromatic diphenolates in a dipolar aprotic solvent, or by electrophilic (Friedel-Crafts) acylation of aryl ethers. PEEK polymers are obtained by step-growth polymerization by the dialkylation of bisphenolate salts. Typically 4,4'-difluorobenzophenone is reacted with a disodium salt of hydroquinone, which is generated in situ by deprotonation with sodium carbonate. The reaction is conducted at around 300° C. in polar aprotic solvents—such as diphenylsulphone, and, in one form, is shown below.

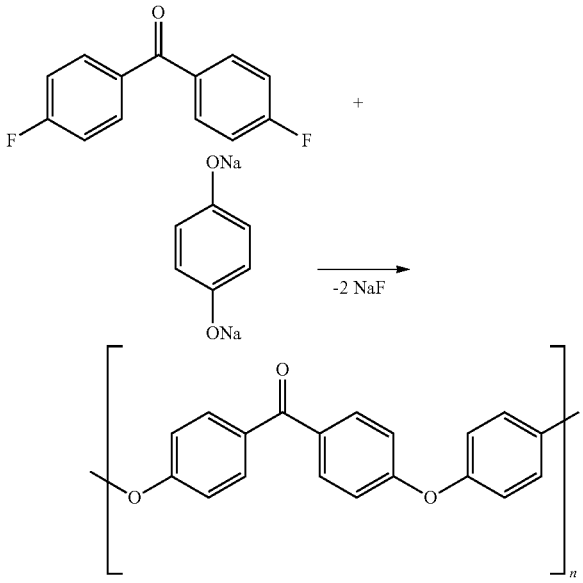

PEEK possesses excellent mechanical and chemical resistance properties that are retained to high temperatures. The Young's modulus is 3.6 GPa and its tensile strength is 90 to 100 MPa. PEEK has a glass transition temperature at around 143° C. (289° F.) and melts around 343° C. (662° F.). It is highly resistant to thermal degradation as well as attack by both organic and aqueous environments. It is attacked by halogens and strong Bronsted and Lewis acids as well as some halogenated compounds and aromatic hydrocarbons at high temperatures.

PEEK also possesses outstanding wear resistance, low moisture absorption and has good dimensional stability. PEEK is an excellent machining material, exhibiting the characteristics of a soft brass. Additionally, PEEK carries a UL 94-V-0 flammability rating and is FDA approved for food contact. PEEK is available from a number of suppliers, including Victrex USA, Inc. of West Conshohocken, PA 19428. When measured by ASTM D3702-94(2009), "Standard Test Method for Wear Rate and Coefficient of Friction of Materials in Self-Lubricating Rubbing Contact Using a Thrust Washer Testing Machine," PEEK frequently exhibits wear factors as high as about 100 $in^3$ min/ft.lbs. hr., or about 150 $in^3$ min/ft.lbs. hr., or about 200 $in^3$ min/ft.lbs. hr., or about 300 $in^3$ min/ft.lbs. hr., or about 375 $in^3$ min/ft.lbs. hr., depending on its formulation.

In one form, the squeeze bars 60 and 62 are formed of a material comprising PEEK. In another from, the tongue 58 is also formed of a material comprising PEEK. In still another form, the transition piece 56 is also formed of a material comprising PEEK. In still yet another form, the short folder 64 and, optionally, the second folder 66 for folding a wrapper material around the compressed tobacco so as to form a continuous rod of tobacco are formed of a material comprising PEEK. With respect to the foregoing, PEEK may be utilized along surfaces that come into contact with tobacco.

It is contemplated that additional components of the apparatus 10 may be formed from PEEK. For example, the conveyor belt guide 70, which the lower conveyor belt 24 rides along, may also be formed from PEEK. In addition, it is contemplated that the transition piece 56 (see FIG. 4) be constructed of PEEK. Use of PEEK along the conveyor belt guide 70 avoids accumulation of material between the conveyor belt guide 70 and the belt 24, which can otherwise lead to jamming of the belt. The belt has the tendency to pick up minute pieces of tobacco during its course of travel.

In one form, the apparatus 10 employs a programmable logic controller (PLC unit) to control the formation of machine-made tobacco rods. Suitable PLC units are available from a number of sources, including Allen-Bradley, a division of Rockwell Automation of Milwaukee, Wisconsin. The vibratory waterfall feeder 20 is fed by a metering belt (not shown) which may be adjusted proportionally to the rod-making speed by signals received by the PLC unit. In one form, there is a sensor provided to monitor rod-making speed and the PLC unit is programmed to dynamically adjust the metering belt in response to changes in rod-making speed.

Various signals, which may include a signal representing the rod diameter, an indication of the tobacco temperature obtained from a temperature sensor that may be located in a tobacco hopper, or in the chamber near the trimmer are fed to the PLC unit. Suitable rod diameter gauges may be as described in U.S. Pat. No. 2,952,262, the contents of which are hereby incorporated by reference in their entirety.

In operation, a tobacco column is carried on the gravity conveyor 24 and drawn by the lower and upper belts 24 and 50, respectively. between the squeeze bars 60 and 62 to the garniture tube belt 42. A signal indicative of the firmness of the finished rod may be used to control the trimmer height preferably after correction to compensate for moisture variations so that the trimmer is controlled in response to the "dry firmness." A control motor may drive the trimmer up and down around an average trimmer height $H_{avg}$, in response to control signals from the microprocessor 66. The actual height H of the trimmer, determined by a trimmer position sensor (not shown), is fed to the PLC unit to provide a signal corresponding to the actual resistance of the part of the filler column that remains after trimming.

From the data received, the PLC unit may calculate characteristics of the finished product and display such information on a display unit. PLC unit and display unit may be housed within a cabinet, which may also include a control panel, the combination of which forms a control system. The control panel may provide the ability to control various functions, including the heaters, glue applicator, machine start-up, system power, etc. Suitable control systems may be obtained from Jewett Automation of Richmond, VA. In one form, control system is a Jewett Automation Model Q75.

Alternatively, or in addition, information can be fed to a central management control system either for instant display or for storage, or for both.

Additionally details concerning process controls and control schemes useful in the operation and control of apparatus 10 are provided in U.S. Pat. No. 4,567,752, the contents of which are hereby incorporated by reference in their entirety.

EXAMPLES

Testing was conducted to evaluate the productivity over an extended period of time for an apparatus designed in accordance with the teachings herein. The focus of the evaluation was on machine runtime v. downtime, material and filler waste and non-conforming product. Performance measurements with respect to productivity included target rod weight, speed in rods per minute, production in terms of trays of product and machine interference downtime. (Machine interference downtime is downtime not directly attributable to the machine, or inherent in the operation of the machine.)

Performance measurements with respect to waste and non-conforming product included loose wrapper and binder, loose filler (collected from the production floor), long-ends (i.e., rod-outs) and wrapper and binder cores.

The data collection procedure employed was as follows. For productivity measurements, data were collected for nine shifts on the inventive rod maker and five shifts on the control maker by the operator who, at the beginning of the shift recorded target rod weight, speed in rods per minute, time to the nearest minute when the machine is first up and running. Each machine interference downtime occurrence was recorded by recording the time that the machine went down and recording the time that the machine was back up and running. An explanation was provided for each downtime occurrence. At the end of the shift, the following were also recorded: time to the nearest minute when the machine was taken down and the total production in trays.

For waste and non-conforming product, data were collected for nine shifts on the inventive rod maker and five shifts on the control maker. Different types of waste (i.e., racker rods, loose wrapper/binder, loose filler, and long-ends) were collected in separate boxes during the shift. At the end of the shift, the boxes were weighed individually, and the weight (in pounds) of each box, minus the tare weight, was recorded. When the operator removed the wrapper and binder cores during bobbin changes, the cores were saved and individually weighed on a scale and data recorded.

Upon completion of data collection, the data were summarized and statistical analyses performed to calculate productivity, waste, and non-conforming product measures. Determined were production utilization efficiency, production per available minute, material waste rates, filler waste rates, non-conforming product rejection rates.

The evaluation was conducted with the inventive rod maker and control rod maker producing product to a target rod weight of 3,300 mg. The inventive rod maker was running at a speed of 1,100 cigars per minute while the control rod maker was operating at a speed of 800 cigars per minute. All productivity calculations assume 3,800 rods per tray. Utilization is equal to runtime divided by total time. Efficiency is equal to runtime divided by available time and available time is equal to total time minus machine interference downtime.

The inventive rod maker produced an average of 101 trays per shift during the evaluation. This compared to an estimated average of 55 or fewer trays per shift produced by the control rod maker.

The inventive rod maker was operated during the evaluation under controlled conditions by an excellent operator; there was no downtime for shift meetings, brand changeovers, scheduled cleanups, preventive maintenance, etc. The productivity measures above may be adjusted to reflect these sources of downtime by estimating the additional downtime, subtracting it from the available time, and applying the production per available minute to the adjusted available time.

Notable causes of machine downtime during the evaluation include: tongue adjustments, a blade break and change, and cleaning of cutter gears.

As specified above, waste data were collected from the inventive rod maker and a control rod maker. During the evaluation, waste was collected from each rod maker and weighed by category. Waste rates for each category were calculated relative to the number of rods produced by the rod makers. The waste rate results are presented below:

Extended Run Evaluation Rod Maker Waste Rate Results

| | Waste per 1,000 Rods Produced (lbs.) | | |
|---|---|---|---|
| Waste Category | Control Rod Maker | New Rod Maker | Reduction |
| Imperfect Fully-formed Rods | 0.487 | 0.044 | 91% |
| Loose Wrapper/Binder at Start-up, Shut-down and Rod-outs | 0.063 | 0.006 | 90% |
| Loose Filler at Start-up, Shut-down and Rod-outs | 0.268 | 0.018 | 93% |
| Long Ends from Rod Formation after a Break in the Rod Upstream of Cutterhead | 0.265 | 0.054 | 80% |

As indicated above, the use of PEEK to form critical components has been found to permit the establishment of tighter part-to-part clearances, minimizing the escape of tobacco during the rod formation operation. Thus, through material selection and the setting of proper clearances, together with the integration of a PLC control system, improved performance was achieved. Forming critical components from PEEK yields components that do not collect tobacco on their surfaces during rod-making operations, since tobacco does not readily adhere to PEEK-produced components.

While the present inventions have been described in connection with a number of exemplary forms, and implementations, the present inventions are not so limited, but rather cover various modifications, and equivalent arrangements, which fall within the purview of the present claims. For example, it is contemplated that the subject matter disclosed herein would have utility in the formation of any wrapped or formed body produced from a tacky shredded material, such as shredded herbal material, pouches of tacky shredded material, moist snuff or the like.

What is claimed:

1. An apparatus comprising:

a pair of squeeze bars in a mutually opposing, converging relation, the pair of squeeze bars configured to compress a stream of material;

a tongue configured to receive the material downstream of the pair of squeeze bars; and a folder configured to fold a wrapper around the material to form a continuous rod of the material, at least one of the pair of squeeze bars, the tongue, and the folder including a semi-crystalline thermoplastic material.

2. The apparatus of claim 1, wherein the semi-crystalline thermoplastic material includes nylon or poly(aryl ether ketone).

3. The apparatus of claim 2, wherein the semi-crystalline thermoplastic material includes the poly(aryl ether ketone), the poly(aryl ether ketone) including polyether ether ketone (PEEK) or poly(ether ketone ketone) (PEKK).

4. The apparatus of claim 3, wherein the poly(aryl ether ketone) includes the PEEK.

5. The apparatus of claim 1, wherein the pair of squeeze bars, the tongue, and the folder each include the semi-crystalline thermoplastic material.

6. The apparatus of claim 1, further comprising:

a lower conveyor belt, and an upper compression belt, the lower conveyor belt and the upper compression belt configured to cooperate with the pair of squeeze bars to compress the stream of material.

7. The apparatus of claim 6, wherein the lower conveyor belt, the upper compression belt, and the pair of squeeze bars define a plurality of clearance gaps therebetween, the clearance gaps having a dimension of less than 0.1 inches.

8. The apparatus of claim 7, wherein the dimension is 0.02 inches.

9. The apparatus of claim 6, further comprising:

a plurality of drive pulleys configured to drive the lower conveyor belt and the upper compression belt.

10. The apparatus of claim 9, wherein the plurality of drive pulleys include the semi-crystalline thermoplastic material.

11. The apparatus of claim 1, wherein the folder includes a short folder and a finishing folder.

12. The apparatus of claim 11, wherein both the short folder and the finishing folder include the semi-crystalline thermoplastic material.

13. The apparatus of claim 1, further comprising:

a feed section configured to provide the stream of material.

14. The apparatus of claim 13, wherein the feed section includes an electromagnetic vibrator.

15. The apparatus of claim 13, further comprising:

a vibratory waterfall feeder between the pair of squeeze bars and the feed section.

16. The apparatus of claim 13, further comprising:

a trimmer configured to establish a uniform height in the stream of material.

17. The apparatus of claim 1, further comprising:

a source of wrapper configured to provide the wrapper to the folder.

18. The apparatus of claim 17, further comprising:

a source of binder configured to provide a binder, the binder configured to be between the material and the wrapper.

19. The apparatus of claim 17, further comprising:

an adhesive applicator configured to apply an adhesive to the wrapper.

20. The apparatus of claim 1, wherein the material includes tobacco.

* * * * *